United States Patent [19]

Brucken et al.

[11] 4,050,852

[45] Sept. 27, 1977

[54] VARIABLE DISPLACEMENT RADIAL PISTON COMPRESSOR

[75] Inventors: Byron L. Brucken, Miamisburg; Roy E. Watt, Brookville, both of Ohio

[73] Assignee: General Motors Corporation, Detroit, Mich.

[21] Appl. No.: 722,643

[22] Filed: Sept. 13, 1976

[51] Int. Cl.[2] ..... F04B 1/24; F04B 49/00

[52] U.S. Cl. ..... 417/273; 74/571 R; 92/13.7; 417/221

[58] Field of Search ..... 417/269, 270, 273, 221; 92/13.7; 74/571 R, 571 L

[56] References Cited

U.S. PATENT DOCUMENTS

| | | | |
|---|---|---|---|
| 2,573,863 | 11/1951 | Mitchell | 417/270 |
| 3,062,020 | 11/1962 | Heidorn | 417/269 |
| 3,073,418 | 1/1963 | Beatley | 417/221 |
| 3,924,968 | 12/1975 | Gains et al. | 417/53 |

*Primary Examiner*—William L. Freeh
*Attorney, Agent, or Firm*—Edward P. Barthel

[57] ABSTRACT

A swash plate radial piston compressor having a toggle action connection means between the swash plate and pistons wherein each piston makes two reciprocations in its cylinder for each 360° of rotation of the compressor input shaft. Means are provided for varying the angle of the swash plate such that a nutating ring, which encircles the swash plate in journaled fashion around the periphery of the swash plate will vary the length of the stroke of the pistons upon a change in the angular position of the swash plate causing a change of volume displacement of the compressor without changing the head clearance of the radial pistons, thus allowing the compressor to go to zero displacement while the input shaft continues to rotate.

3 Claims, 6 Drawing Figures

VARIABLE DISPLACEMENT RADIAL PISTON COMPRESSOR

This invention relates to compressors for refrigerating systems and is directed to a modulating radial piston compressor.

With the increased emphasis on energy conservation, it has been increasingly important to reduce the size and weight of various automotive components including the air conditioning systems used therewith. The present invention involves a novel radial piston air pump or compressor for use in an automotive vehicle air conditioning system.

It is an object of the present invention to provide an improved radial piston compressor of the swash plate type in which the angular position of the swash plate can be changed resulting in the length of stroke of the pistons being adjusted to provide a variable volume displacement compressor.

Another object of the invention is to provide a radial piston swash plate type compressor having connecting means between the swash plate and each piston, arranged such that each of the pistons make two reciprocations in their cylinders for each 360° of rotation of the compressor input shaft.

It is another object of the present invention to provide a radial piston swash plate compressor for automotive air conditioning systems which comprises three or more radial movable pistons each of which is connected to a nutating ring encircling the swash plate, wherein each connecting rod between the ring and its associated piston creates a toggle action such that each piston will travel through two cycles in its cylinder for each 360° of rotation of the input shaft; and whereby means are provided for automatically changing the number of degrees that the nutating ring will be swept through, the effective stroke length of the piston can be varied to accomplish a change of volume dislacement of the compressor without altering the head clearance of each piston.

Further objects and advantages of the present invention will be apparent from the following description, with reference being had to the accompanying drawings, wherein preferred embodiments of the present invention are clearly shown. In the Drawings.

Figure 1:
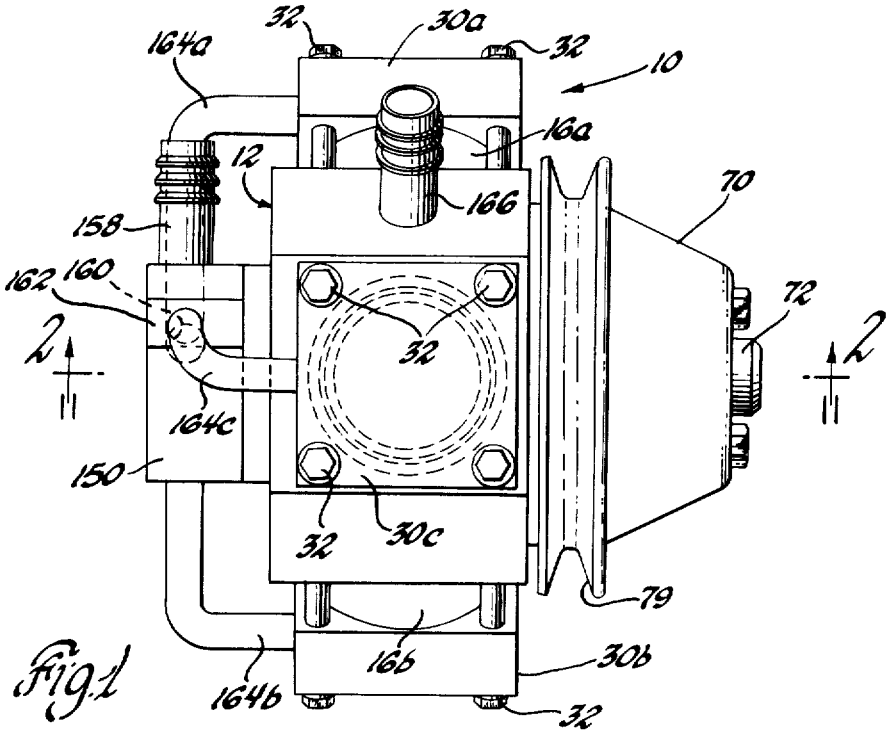
FIG. 1 is a side elevational view of the compressor constructed according to the invention.

Referring now to the drawings, wherein preferred embodiments of the invention have been shown, the compressor 10 of the embodiment shown in FIGS. 1—5 includes a rigid cast aluminum cylindrical housing section 12 preferably provided with an odd number of radial cylinders equi-angularly spaced about the axis of the housing section and extending outwardly from a central inlet chamber 14. As viewed in FIG. 3, the housing section 12 is provided with three compression chambers or cylinders **16*a*, 16*b* and 16*c* having cylinder bores 18*a*, 18*b* and 18*c*** respectively, but it is understood that the number of cylinders may be increased or decreased depending upon the capacity desired.

Figures 3, 4, 5:
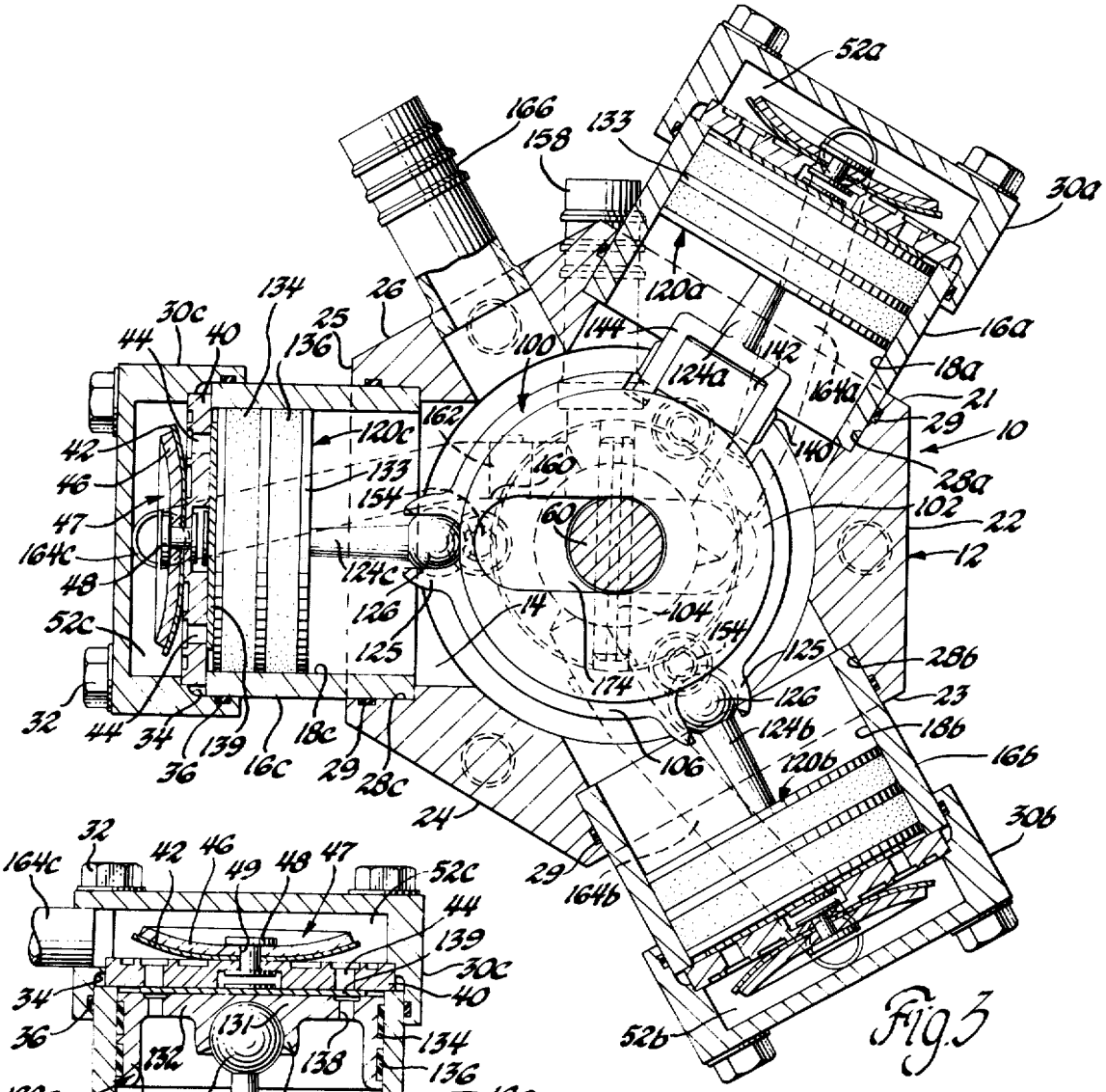
FIG. 3 is a sectional view taken in the direction of line 3—3 of FIG. 2, with piston shown at top-dead-center.
FIG. 4 is a fragmentary sectional view, partly in elevation, of the swash plate and one compression chamber.
FIG. 5 is a fragmentary view, partly in section, of one connecting rod of the compressor.

The housing section 12, since it has three cylinder bores, is made hexagonal in transverse cross section as best illustrated in FIG. 3. Thus, the housing section 12 provides six sides 21–26 with the cylinder bore walls or sleeves **18*a*–18*c* having their inner ends received in counterbored openings 28*a*, 28*b* and 28*c* respectively, formed in the housing sides 21, 23 and 25 respectively, and sealed therein by O-ring seals 29** in internal grooves.

As shown in FIGS. 1 and 3, each cylinder has its outer end closed by an associated cap member **30*a*, 30*b* or 30*c* which is generally square in plan and is suitably secured to the housing 12 as by bolts 32 with the cylinder received in cap bore 34 and sealed by O-ring 36. A valve plate 40 is positioned against the cylinder upper edge and is retained by the cap member. An annular discharge reed plate 42 controls flow through a series of circumferentially spaced discharge apertures 44 and is retained by a curved plate 46, the valve plate assembly 47 or discharge valve means being secured together by a rivet 48 in a central counterbored aperture 49 in the valve plate 40. The reed plate 42 controls flow of pressurized gas into a discharge chamber 52 of cap member 30*c*. The valve plate assembly 47** is substantially the same as shown in U.S. Pat. No. 3,887,301 issued June 3, 1975 to H. D. Henkel, assigned to the same assignee as the present application, and reference may be had to the Henkel patent for additional details.

Figure 2:
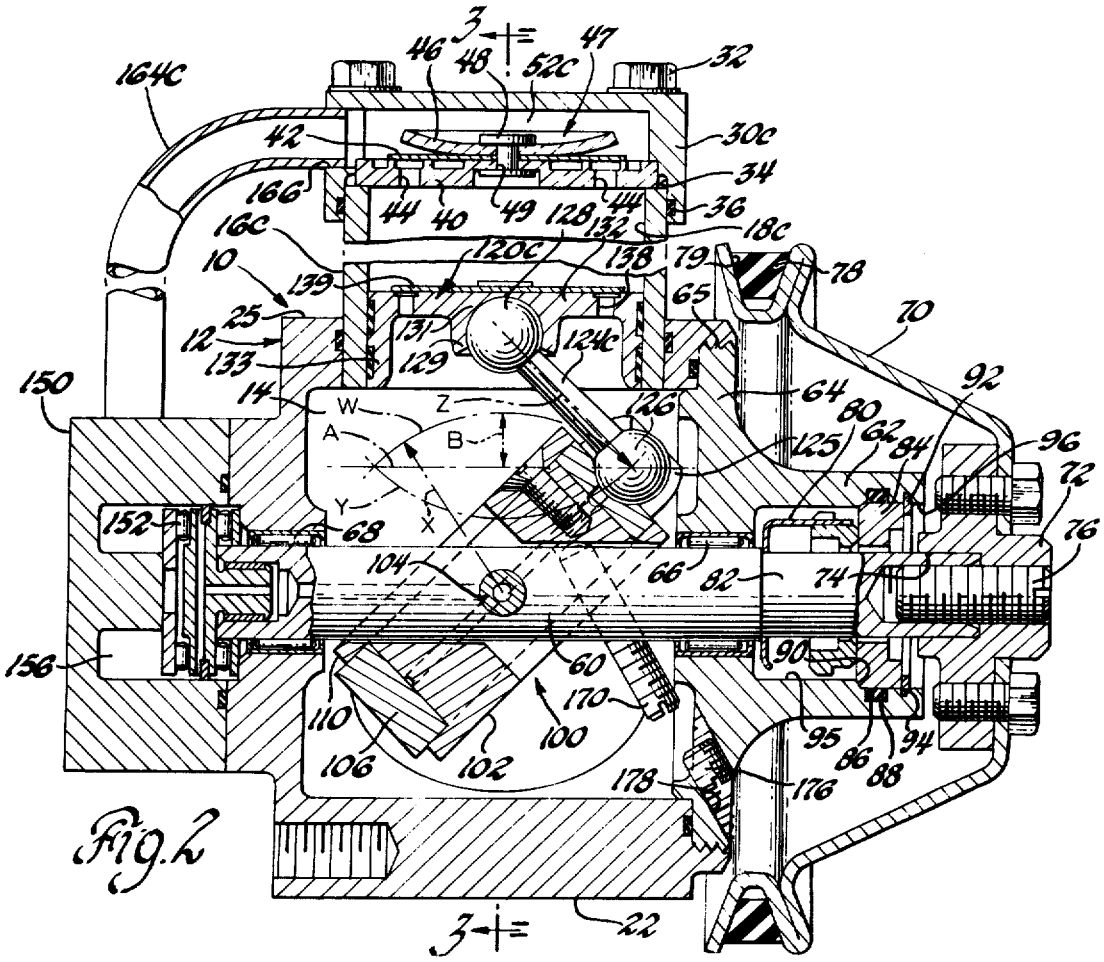
FIG. 2 is a horizontal cross-sectional view of a compressor in FIG. 1 taken along the line 2—2.

FIG. 2 shows the compressor 10 being driven from the front end of a drive shaft 60 with its front portion supported for rotation through tubular hub 62, preferably an integral extension of front cover section 64, by main front needle bearing assembly 66. The cover section 64 is threaded at 65 for sealed reception in an internally threaded front opening of the housing, while the compressor housing 12 has an aligned rear opening for receiving the rear shaft portion and its associated rear bearing assembly 68.

A drive pulley 70 is secured on the front end of the drive shaft 60 by means of a cylindrical pulley hub 72 mounting member having a concentric bore 74 receiving the front end of the shaft 60 with an axial screw 76 threaded through the hub 72 into the end of the shaft. The drive pulley 70 imparts rotation to the output drive shaft 60 in response to the operation of a drive source, such as an automobile engine driven belt 78 in pulley groove 79. A rotating shaft seal 80 is mounted around the front end reduced portion 82 of the drive shaft 60 and is in sealing engagement with a stationary seal ring 84, the latter being sealed to the tubular hub 62 by an O-ring type seal ring 86 mounted in a first groove 88 formed in the inner peripheral surface of the hub. The seal ring 84 is confined axially between a shoulder 90, formed within the tubular hub 62, and a split locking ring 92 mounted in a second groove 94 formed in the inner peripheral surface of the hub. Innner bore 95 of the hub is enlarged at 96 to facilitate assembly and removal of the locking ring 92, the stationary seal ring 84, and the rotating part of the shaft seal 80.

The compressor drive shaft 60 has wobble plate means in the form of a swash plate assembly 100 having a swash plate 102 pivotally mounted thereon for rotation therewith. As viewed in FIG. 3, the swash plate 102 is supported by pivot pins 104 extending with their aligned axis transverse to the rotational axis of the shaft 60 so as to intersect therewith.

It will be observed in FIG. 4 that the swash plate 102 is encircled by an outer nutating ring member 106 journaled on the periphery thereof allowing the swash plate 102 freedom to rotate with the drive shaft 60 relative to the ring member 106. A recessed journal groove or channel raceway 108 is formed on the periphery of the swash plate 102 having a left-hand plate potion 110 (FIG. 4) of the swash plate removable to allow the ring 106 to be positioned thereon after which plate portion 110 is suitably secured as by bolts 112. The ring member 106 is operatively associated with a plurality of piston means arranged to reciprocate in their associated bores positioned in symmetrical radiating fashion from the common central inlet chamber 14 of the housing. While the compressor 10 is illustrated as having three cylinders 16*a*, 16*b* and 16*c*, it will be appreciated that any number of multiple cylinder combinations may be employed without departing from the scope of the invention.

The piston means, as seen in FIGS. 3 and 4, are in the form of piston assemblies 120*a*, 120*b* and 120*c* each comprising a central portion 131 which terminates in an integral cup portion 132 having a relatively short skirt portion 133 providing an outer surface engaging its associated cylinder bore wall 18*a*. The outer surface of the piston assembly contains a relatively wide groove or pair of grooves receiving matched Teflon sealing rings 134, 136 providing a fluid-tight seal between the outer surface of the piston and the cylinder bore. The piston assembly also includes circumferentially spaced inlet apertures 138 which are normally closed by a suction reed plate 139 or a suction valve means which is operative to regulate flow of gas into the compression bores from the inlet chamber 14 of housing member 12.

Each of the piston central portions 131 has socket portions 129 capturing spherical potions 128 on the outer end of connecting rod members drivingly connecting the pistons 120*a*, 120*b* and 120*c* to the ring member 106. The rod members are in the form of circumferentially spaced connecting rods shown at 124*a*, 124*b* and 124*c* extending from the ring member 106 into each of the cylinder bores 18*a*, 18*b* and 18*c* respectively, with each rod connected through the ball joint universal to its associated piston. The ring member 106 of the wobble plate assembly is provided with a plurality of inner sockets shown at 125 which receive or capture the inner spherical ends 126 of their associated connecting rod as shown by the connecting rod 124*c* ball joint which is visible in FIG. 2.

It will be noted in FIG. 5 that connecting rod 124*a* for piston assembly 120*a* is hingedly connected to the ring member 106 by means of a hinge pin 140 journaled in a ring socket 142. The pin 140 is received in a U-shaped shackle or clevis 144 formed on the inner end of rod 124*a*. The pivotal axis of the pin 140 is substantially normal to the drive shaft axis, whereby the rod 124*a* hinge connecting means is operable to prevent the ring member 106 from rotating with the wobble plate 102 during the rotational movement of the drive shaft 60, or said differently, the ring member 106 nutates while the shaft 60 rotates. Thus, each of the pistons operate within its compression cylinder bore 18 whereby upon rotation of the drive shaft 60 the wobble plate will cause each connecting rod to have simultaneous rotation and nutation motion causing reciprocation of the pistons within their associated compression chambers.

As seen in FIGS. 1 and 2, a manifold discharge rear hub 150 is mounted on the compressor housing so as to enclose the rearward end of the shaft thrust bearing assembly 152 by any suitable means such as a plurality of Phillips head screws shown at 154 in FIG. 3. The manifold hub defines a cavity 156 from which the pressurized gas is exhausted via exhaust tube 158 in FIG. 3. The discharge block or hub 150 is provided with a plurality of gas receiving passages or inlet openings one of which is shown at 160 in FIG. 1 equaling the number of compression chambers. The hub inlets are located in notched-out flat areas 162 formed at equi-angular intervals about the periphery of the hub. Suitable right-angled conduits 164*a*, 164*b* and 164*c* are provided for each inlet to connect same with its associated discharge pressure chamber 52*a*, 52*b* and 52*c* respectively, via outlets such as outlet 166 for cap member 30*c* in FIG. 2. The housing central inlet chamber 14 is connected on intermediate compressor housing face 26 by suction gas inlet tube 166.

As is known in the art of compressor output modulating means as shown in U.S. Pat. No. 3,062,020, issued Nov. 6, 1962 to John Heidorn, to provide an arrangement for modulating the output of a compressor compensating for wide variations in compressor speeds and wide variations in refrigeration requirements. Thus, by changing the angular relationship between the inclination of the swash plate 102 and the drive shaft so as to vary the stroke of the pistons, the displacement of the pump may be varied throughout a predetermind range or ratio.

In the embodiment of FIGS. 1–5 the pump is capacity modulated manually by an adjusting screw 170 that may be set to maintain the desired swash plate angle by being threaded through a bore in the drive shaft such that its rounded end 172 engages an inclined contact surface 174. Thus by removing set screw plug 176 in aligned threaded bore 178 in the pump housing the adjusting screw can be axially set by a screwdriver. Ordinarily, at the full-load position the swash plate 102 will be tilted to its maximum degree as seen in FIG. 2 whereby maximum compressor capacity is obtained. As the rotational speed of the shaft 60 increases and/or the lod decreases, the compressor requirement is reduced and thus the displacement of the compressor may be reduced by adjusting the inclination of the swash plate by means of screw 170 toward a position where it lies in a plane at substantially right angles to the axis of the shaft as shown in FIG. 4 The arrangement is such that in the extreme position of movement when the wobble plate 102 is disposed in a plane perpendicular to the axis of rotation of the shaft 60 it will render the compressor ineffective to compress refrigerant.

By the above-described arrangement it will be seen that applicants' compressor provides a "toggle action" wherein each piston will make two reciprocations in its cylinder for each 360° of rotation of the input shaft and swash plate. Thus, by changing the number of degrees that the nutating ring 106 of the swash plate 102 will be swept through, the length of stroke of each piston can be uniformly varied. This action accomplishes a change of volume displacement of the compressor without changing the head clearance, as each of the pistons will always be moved to a constant top dead center position approaching zero clearance as shown in FIG. 4, for example. As is well known, in such a pump or compressor, it is desirable to ideally have zero clearance between the piston and the housing at the top of the pumping stroke to obtain maximum pumping efficiency at all displacements of the unit. Expressed differently, the compressor action accomplishes a change of volume displacement of the compressor, without changing the head clearance, thereby allowing the compressor to go to zero displacement wherein the swash plate is positioned at substantially right angles relative to the shaft, although the input shaft continues to rotate.

Figure 6:
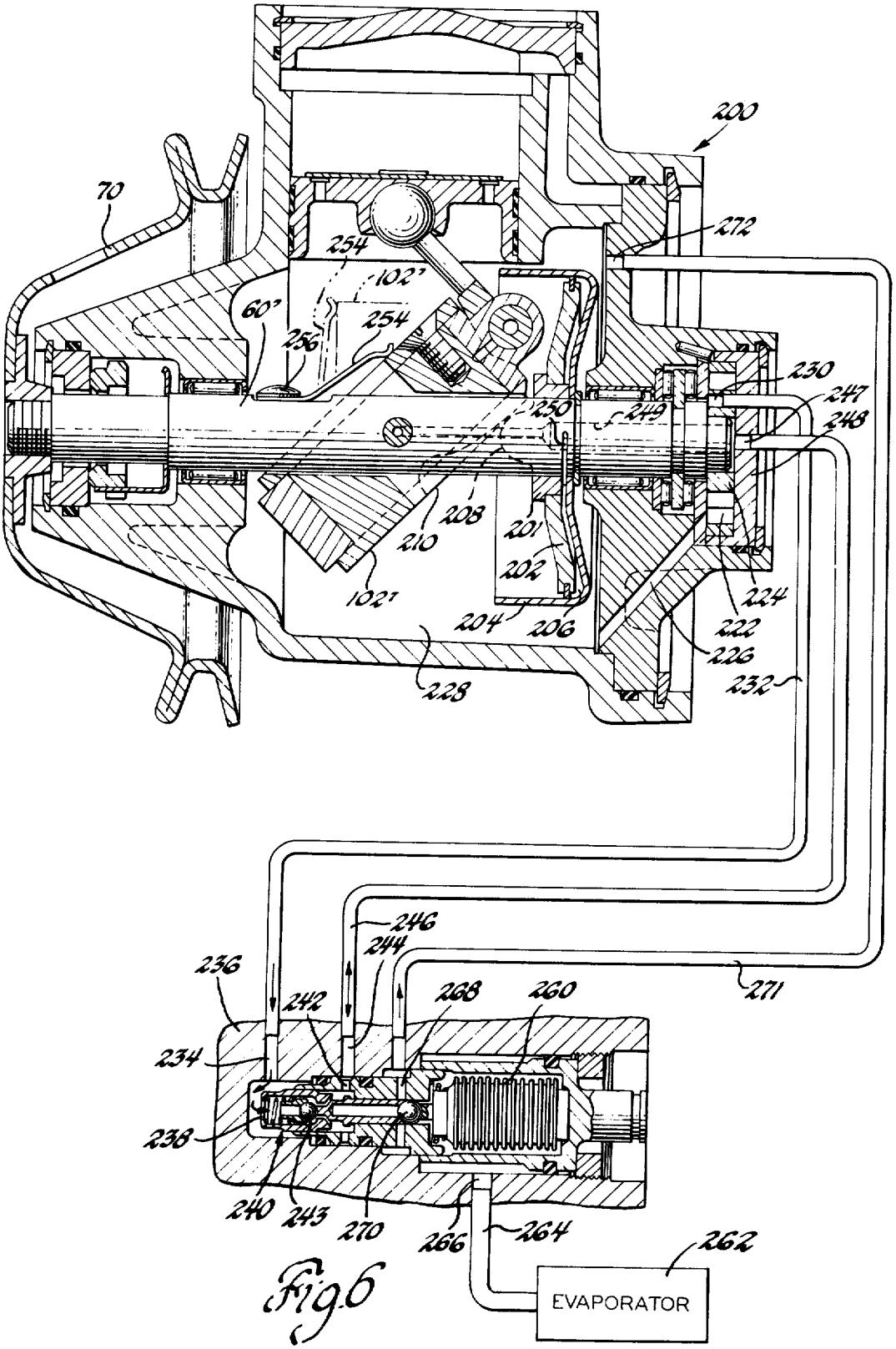
FIG. 6 is a view similar to FIG. 2 in modified form of the compressor with a schematic representation of an automatic control system therefor.

FIG. 6, in which the same reference numerals have been used with primes to indicate the same or similar elements, illustrates a second embodiment of the present invention. When such parts are substantially the same, such parts are not described, and reference is made to FIGS. 1-5 for the operation and construction of these parts.

In the embodiment of FIG. 6, the swash plate 102 of the compressor pump 200 is automatically modulated for use in an automobile air conditioning system, for example, in which the compressor pump is adapted to be directly driven by a car engine at all times, and in which compressor output is modulated in response to refrigeration requirements. As seen in FIG. 6, the shaft 60' has an axial slide 201 which is in turn secured to a piston element 202 which cooperates with a stationary cup-shaped member 204 so as to form an expansible chamber 206. The size of the expansible chamber 206 is varied by supplying lubricant under pressure into the chamber 206. At high lubricant pressures, the plate-like piston element 202 will be shifted to the left so as to cause the slide 201 to move to the left. Movement of the slide 201 to the left serves to cause its camming nose portion 208 to engage a camming surface 210 of the swash plate 102' thereby causing a reduction in the angle of the swash plate element 102' relative to the shaft. The arrangement is such that in the extreme position of movement of the slide element 201 and piston 202 to the left, the swash plate will be disposed in a plane perpendicular to the axis of rotation of the shaft 60' so as to render the compressor ineffective to compress refrigerant. FIG. 6 shows the arrangement of the swash plate 102' for maximum compressor capacity while the arrangement for zero displacement (zero stroke) is shown by the dashed line position of the swash plate at an angle of 90°.

A gear-type oil pump is provided of the type shown for example in the U.S. Pat. No. 3,062,020 to Heidorn which includes an external gear 222 and an internal gear element 224 drivingly connected as by a key to the inner end of the drive shaft 60' so as to be driven thereby. The oil pump has a first suction inlet 226 which serves to withdraw lubricant from the main oil sump 228 formed in the lower part of the compressor housing and an outlet 230 connected by line 232 to inlet 234 in valve housing 236 for flow into the axial high pressure oil inlet orifice 238 of hydraulic control valve 240. The valve 240 has a control orifice 242, controlled by valve ball check 243, connected to housing passage 244 and line 246 to oil feed a passage 247, formed in the front head cover 248. The passage 247 communicates with an axially extending passage 249 provided in the drive shaft 60' and a radially extending passage 250 whereby oil under pressure is either fed or bled from the compressor modulating control chamber 206, as seen by the arrows indicating oil flow, depending upon whether the piston 202 is moved to the left to reduce the piston's stroke or to the right to increase the stroke. It will be noted that the leaf spring 254, fixed on shaft 60' by fastener 256, is operative to bias the swash plate 102' into the full line position at an angle of about 45° to the shaft 60' for maximum pumping capacity.

The valve 240 is controlled or actuated by a pressure signal from the evaporator by means of a pressure sensitive bellows 260 which is sensitive to the pressure of evaporator 262 via line 264 and housing inlet 266. The valve has an outlet 268 controlled by valve ball check 270. The valve is so calibrated that when the pressure within the system exceeds a desired value, the valve ball 270 will open so as to allow excess oil to return via line 271 to the compressor crankcase 228 via inlet 272. Thus, the evaporator pressure is regulated by varying the displacement of the compressor to match the cooling requirement.

As seen by the dashed construction lines in FIG. 2, it will be appreciated that the center of sphere 126 moves on an arc W of a fixed radius X, centered at pin 104. As the location of the center of sphere 128 varies, depending upon the angle of the swash plate 102, an arc Y defined by a radius Z, centered by sphere 128, will subtend a progressively decreasing cord length common to the intersecting arcs W and Y as the swash plate approaches its 90° zero displacement orientation relative to the shaft. The result is that the length of the stroke for each piston is always twice the height of the cord or middle ordinate defined by the intersection of arcs W and Y. For example, as seen in FIG. 2 in the case of maximum piston displacement each stroke has a length which is twice the height of common cord A, or twice the middle ordinate dimension B.

While the embodiment of the present invention as herein disclosed constitutes a preferred form, it is to be understood that other forms might be adopted.

We claim:

1. A radial compressor comprising a housing having a plurality of symmetrical bores therein radiating from a common chamber in said housing, a drive shaft journalled in said housing with its axis intersecting all the axes of the bores, said shaft having a wobble plate supported thereon at some predeterminated angle thereto so as to be rotatable therewith, said wobble plate encircled by an outer ring member journalled on the periphery thereof such that said wobble plate is free to rotate relative to said ring member, piston means operating within all of said bores, rod members drivingly connecting each of the piston means to said ring memer, said rod members in the form of circumferentially spaced connecting rods extending from said ring member into each bore, each said rod universally connected to the piston means in its associated bore, means hingedly connecting one of said rods to said ring member for pivotal movement solely about an axis substantially normal to the axis of said shaft, the remaining rods having their ring ends universally connected to said ring member, whereby said one rod hinge connecting means is operable to prevent said ring member from rotating with said wobble plate during the rotational movement of said shaft, and whereby said wobble plate imparts a single working stroke toggle action to each rod for driving each of the piston means through one working stroke reciprocation in its associated bore during each 180° rotation of said shaft, whereby each of the piston means will travel through two working stroke reciprocations in its associated bore for each 360° rotation of said shaft.

2. A radial compressor comprising a housing having three symmetrical boes therein radiating from a common chamber in said housing at about 120° spaced intervals, a drive shaft journalled in said housing with its axis intersecting all the axes of the bores, said shaft having a wobble plate supported thereon at some predeterminated angle thereto so as to be rotatable therewith, said wobble plate encircled by an outer ring member journalled on the periphery thereof such that said wobble plate is free to rotate relative to said ring member, a piston operating within each of said three bores including a socket portion on its inner end, rod members drivingly connecting each of the three pistons to said ring member, said rod members in the form of circumferentially spaced connecting rods extending from said ring member into each bore, each said rod having a spherical end universally connected to a piston socket portion, means hingedly connecting one of the rods to said ring member for pivotal movement solely about an axis substantially normal to the axis of said shaft, the remaining rods having their ring ends provided with a spherical end universally connected to said ring member by a socket portion thereon, whereby said one rod hinge connecting means is operable to prevent said ring member from rotating with said wobble plate during the rotational movement of said shaft, and whereby said wobble plate imparts a single working stroke toggle action to each rod for driving each of the pistons through one working stroke reciprocation in its associated bore during each 180° rotation of said shaft, whereby each of the three pistons will travel through two working stroke reciprocations in its associated bore for each 360° rotation of said shaft.

3. A radial compressor comprising a housing having a plurality of symmetrical bores therein radiating from a common chamber in said housing, a drive shaft journalled in said housing with its axis intersecting all the axes of the bores, a valved head located at the outer end of each said bore, said shaft having a wobble plate supported thereon for rotatable movement therewith about an axis transverse to the axis of said drive shaft, said wobble plate encircled by an outer ring member journalled on the periphery thereof such that said wobble plate is free to rotate relative to said ring member, pistons operating within each of the bores at a predetermined clearance from its head end, means for varying the angular position of said wobble plate with respect to said drive shaft between an orientation normal to the axis of said shaft and an infinite number of inclined positions so as to uniformly vary the length of the working stroke of each of the pistons while maintaining said predetermined piston head clearance, rod members drivingly connecting each of said piston means to said ring member, said rod members in the form of circumferentially spaced connecting rods extending from said ring member into each of the bores, each said rod universally connected to the piston means in its associated bore, means hingedly connecting one of said rods to said ring member for pivotal movement solely about an axis normal to the axis of said shaft, the remaining rods universally connected to said ring member whereby said one rod hinge connecting means is operable to prevent said ring from rotating with said wobble plate during the rotational movement thereof, and whereby said wobble plate imparts a single working stroke toggle action to each rod for driving each of the piston means through one working stroke reciprocation in its associated bore during each 180° rotation of said shaft such that each piston means will travel through two working stroke reciprocations in its associated bore for each 360° rotation of said shaft, and whereby said means for varying the angular positions of said wobble plate is operative to change the volume displacement of the piston bores from zero displacement with said wobble plate positioned normal to said drive shaft axis to maximum displacement with said wobble plate moved to its minimum inclination with respect to said drive shaft axis.

* * * * *